US010297891B2

(12) United States Patent
Fleancu et al.

(10) Patent No.: US 10,297,891 B2
(45) Date of Patent: May 21, 2019

(54) HIGH FREQUENCY PHASE SHIFTER UNIT

(71) Applicant: KATHREIN SE, Rosenheim (DE)

(72) Inventors: Dan Fleancu, Griesstaett (DE); Joerg Langenberg, Rosenheim (DE); Michael Thunn, Haag (DE)

(73) Assignee: KATHREIN SE, Rosenheim (DE)

( * ) Notice: Subject to any disclaimer, the term of this patent is extended or adjusted under 35 U.S.C. 154(b) by 277 days.

(21) Appl. No.: 15/069,775

(22) Filed: Mar. 14, 2016

(65) Prior Publication Data

US 2016/0276745 A1 Sep. 22, 2016

(30) Foreign Application Priority Data

Mar. 16, 2015 (DE) ..... 10 2015 003 357

(51) Int. Cl.
*H01P 1/18* (2006.01)
*H01Q 3/04* (2006.01)
(Continued)

(52) U.S. Cl.
CPC ..... *H01P 1/184* (2013.01); *H01P 5/08* (2013.01); *H01Q 1/246* (2013.01); *H01Q 3/04* (2013.01); *H01Q 3/32* (2013.01)

(58) Field of Classification Search
CPC ... H01P 1/184; H01P 5/08; H01P 9/00; H01Q 3/04; H01Q 3/32; H01Q 1/246
(Continued)

(56) References Cited

U.S. PATENT DOCUMENTS 6,850,130 B1 2/2005 Gottl et al.
7,463,190 B2 * 12/2008 Zimmerman ..... H01Q 1/243 333/156
(Continued)

FOREIGN PATENT DOCUMENTS

CN 101694897 A 4/2010
CN 101821899 A 9/2010
(Continued)

OTHER PUBLICATIONS

State Intellectual Property Office of the People's Republic of China, Office Action and Search Report Issued in Application No. 201610151181.7, dated May 23, 2018, 23 pages. (Submitted with Partial Translation).

*Primary Examiner* — Rakesh B Patel
*Assistant Examiner* — Jorge L Salazar, Jr.
(74) *Attorney, Agent, or Firm* — McCoy Russell LLP

(57) ABSTRACT

The present disclosure shows a high-frequency phase shifter assembly having at least two high-frequency phase shifters stacked above one another which are arranged in at least one housing, wherein at least one housing plate is provided between the high-frequency phase shifters in the stack; and wherein the high-frequency phase shifters each have a rotatably supported pick-up element which is electrically coupled to a feed line via a coupling point arranged in the region of its rotary axle; and wherein the pick-up elements of the high-frequency phase shifters are mechanically coupled for the synchronous adjustment of the high-frequency phase shifters. Provision is made in this respect that the mechanical coupling of the pick-up elements of the high-frequency phase shifters takes place via a coupling arrangement spaced apart from the rotary axles of the pick-up elements.

24 Claims, 8 Drawing Sheets

(51) Int. Cl.

| | |
|---|---|
| ***H01Q 1/24*** | (2006.01) |
| ***H01Q 3/32*** | (2006.01) |
| ***H01P 5/08*** | (2006.01) |

(58) Field of Classification Search
USPC ..... 333/24 R, 139, 156, 161
See application file for complete search history.

(56) References Cited

U.S. PATENT DOCUMENTS

| | | | |
|---|---|---|---|
| 2008/0024385 | A1 | 1/2008 | Zimmerman |
| 2010/0219907 | A1 | 9/2010 | Kim et al. |
| 2013/0063225 | A1 | 3/2013 | Deng et al. |

FOREIGN PATENT DOCUMENTS

| | | | |
|---|---|---|---|
| EP | 1208614 | B1 | 9/2003 |
| JP | H06326501 | A | 11/1994 |
| KR | 101150465 | B1 | 6/2012 |
| WO | 03036759 | A1 | 5/2003 |
| WO | 2015150168 | A1 | 10/2015 |

* cited by examiner

HIGH FREQUENCY PHASE SHIFTER UNIT

CROSS REFERENCE TO RELATED APPLICATION

This application claims priority to German Patent Application No. 10 2015 003 357.3, entitled "High-Frequency Phase Shifter Assembly," filed on Mar. 16, 2015, the entire contents of which is hereby incorporated by reference in its entirety.

TECHNICAL FIELD

The present disclosure relates to a high-frequency phase shifter module having at least two high-frequency phase shifters which are stacked above one another and which are arranged in at least one housing.

BACKGROUND AND SUMMARY

High-frequency phase shifters are used in antenna engineering for changing the phase position of a signal with which the radiators of an antenna array are supplied. High-frequency phase shifters in particular serve for the electrical tilt of the radiation pattern.

High-frequency phase shifters typically have a rotatably supported pick-up element which is electrically coupled to a feed line via a coupling point arranged in the region of its rotary axle. The pick-up element contacts a stripline section at different positions depending on its rotary position. The signal path and thus the phase position are hereby varied depending on the rotary position of the pick-up element, the pick-up element can in particular be configured in pointer form and can optionally contact a plurality of stripline sections which are arranged at different distances from the rotary axle of the pick-up element. A high-frequency phase shifter can hereby control a plurality of radiators each having different phase shifts. Such a high-frequency phase shifter is known, for example, from EP 1 208 614 B1.

It is, however, frequently necessary with larger antenna arrays to use a plurality of separate high-frequency phase shifters which are, however, synchronously adjusted. To achieve a particularly compact arrangement of the high-frequency phase shifters, they can be arranged stacked above one another. To shield the high-frequency phase shifter toward the outside, they are typically arranged in a housing. To adjust the pick-up elements of the high-frequency phase shifters synchronously, they are mechanically coupled to one another by a common rotary axle in the stack with known high-frequency phase shifter assemblies. The pick-up elements hereby rotate synchronously on a rotation of the common rotary axle.

In prior art high-frequency stacked phase shifter assemblies, a housing plate having an axial passage in the region of the rotary axle, is typically provided in the stack between the high-frequency phase shifters for the electrical decoupling of the high-frequency phase shifters. The shielding of the high-frequency phase shifters between one another is, however, hereby degraded just where the signal is fed from the feed lines into the pick-up elements. This has negative effects on the electrical decoupling of the high-frequency phase shifters. The distance between the two phase shifters and the diameter of the axial passage as well as the material of the axial passage are decisive for the decoupling of the two phase shifters, with it having partly been necessary in the prior art to increase the spacing of the phase shifters in the stack to achieve a sufficient decoupling. Due to the restrictions of construction space and to the mechanical demands on the common rotary axle, the decoupling of the high-frequency phase shifters in the stack can therefore not be improved as desired.

It is therefore the object of the present disclosure to further develop a high-frequency phase shifter assembly having at least two phase shifters stacked above one another such that the decoupling of the high-frequency phase shifters in the stack is improved.

This object is achieved in accordance with the present disclosure by a high-frequency phase shifter assembly having at least two high-frequency phase shifters, and by a stackable high-frequency phase shifter.

Advantageous embodiments of the present disclosure form the subject of the dependent claims.

The present disclosure comprises a high-frequency phase shifter assembly having at least two high-frequency phase shifters which are stacked above one another and which are arranged in at least one housing, wherein at least one housing plate is provided between the high-frequency phase shifters in the stack. The high-frequency phase shifters each have a rotatably supported pick-up element which is electrically coupled to a feed line via a coupling point arranged in the region of its axis of rotation. The pick-up elements of the high-frequency phase shifters are mechanically coupled for the synchronous adjustment of the high-frequency phase shifters. Provision is made in accordance with the present disclosure that the mechanical coupling of the pick-up elements of the high-frequency phase shifters takes place via a coupling arrangement spaced apart from the rotary axles of the pick-up elements.

The mechanical coupling thus no longer takes place in accordance with the present disclosure by a common rotary axle of the frequency phase shifters, but rather via a coupling arrangement spatially separate from the rotary axles. This allows the rotary axles of the individual pick-up elements to be completely separated from one another and also to allow an improved shielding by the housing plate arranged between the high-frequency phase shifters in the region of the rotary axles.

Since no continuous rotary axles of the pick-up elements is provided at the stack, but the mechanical coupling rather takes place spaced apart from the rotary axles, an improved decoupling is possible in accordance with the present disclosure. The high-frequency phase shifters may have an electrical decoupling of at least 25 dB, optionally of at least 29 dB, further optionally of at least 35 dB, and further optionally of at least 40 dB.

In accordance with the present disclosure, the spacing of the phase shifters in the stack can be reduced in accordance with the present disclosure since it is no longer as decisive in the same way for the decoupling as in accordance with the prior art, the spacing of the phase shifters in the stack can be less than 17 mm, optionally less than 15 mm, and further optionally less than 12 mm.

Since a continuous rotary axle of the pick-up elements is no longer provided, the housing plate arranged between the high-frequency phase shifters in the stack in the region of the rotary axle no longer has to have a passage opening for the rotary axle so that this region of the housing plate can be improved with respect to its decoupling properties, apertures, for example in the form of inspection openings, can by all means still be provided in the region of the rotary axles. They can, however, be smaller than the axial passages required in the prior art.

The at least one housing plate arranged in the stack between the high-frequency phase shifters may have no apertures in the region of the rotary axles of the pick-up elements whose outer circumference is greater than ⅛ of the minimal wavelength of the signals at which the high-frequency phase shifter assembly is operated. The housing plate optionally has no apertures in the region of the rotary axles of the pick-up elements whose outer circumference is greater than 1/10, and optionally greater than 1/15, of the minimal wavelength of the signals. The outer circumference is of particular importance for the electrical decoupling due to induced circulating current about the margins of the opening.

The housing plate therefore may have no apertures relevant for the electrical decoupling in the region of the rotary axles. The apertures should in particular also not relevantly impair the shielding for the minimal wavelength of the signals at which the high-frequency phase shifter assembly is operated. In a possible embodiment, the housing plate has no apertures at all in the region of the rotary axles.

With the high-frequency phase shifter assemblies in accordance with the present disclosure, the high-frequency phase shifters can be stacked above one another such that the rotary axles of the respective pick-up elements extend in parallel with one another and are optionally aligned with one another. This allows a particularly compact arrangement. The coupling points arranged in the region of the rotary axles for the decoupling of the signals into the pick-up elements are also electrically decoupled from one another with such an aligned arrangement of the rotary axles since the housing plate disposed therebetween prevents an electrical coupling.

The pick-up elements of the high-frequency phase shifters are configured in pointer shape in a preferred embodiment and have one or more coupling points with which they are electrically coupled to one or more stripline sections. The ends of the stripline sections can be connected to radiators so that the wavelength of the signals to the radiators and thus the phase position is shifted by a rotation of the pick-up element, the one or more stripline sections may extend concentrically about the rotary axle of the pick-up element. If a plurality of stripline sections are provided, they typically have a different radial spacing from the rotary axle so that the adjustment of the pick-up element results in different phase shifts for the individual stripline sections. The pick-up element itself can likewise be configured as a rotatable stripline section of pointer shape, wherein, with a plurality of stripline sections, the coupling points of the pick-up element to the stripline sections are arranged following one another at the stripline section of pointer shape forming the pick-up element.

The coupling between the feed line and the pick-up element may take place capacitively in the region of the coupling point, the pick-up element can in particular have a ring-shaped line section in the region of the rotary axle, said ring-shaped line section being separated by a dielectric from a line section likewise of ring shape and connected to the feed line. The coupling between the pick-up element and the stripline sections optionally also takes place capacitively.

The individual high-frequency phase shifters in the stack can be configured such as is known from EP 1 208 614 B1.

The high-frequency phase shifter assembly in accordance with the present disclosure can in a first embodiment have a common housing in which at least two high-frequency phase shifters are arranged stacked above one another. In this case, the at least two high-frequency phase shifters are separated from one another by an intermediate plate of the housing. If more than two high-frequency phase shifters are provided, a respective at least one intermediate plate is provided between the individual high-frequency phase shifters.

In an alternative embodiment, the high-frequency phase shifters can each have their own housing, with the housings of the high-frequency phase shifters being stacked on one another and being connected to one another for forming the high-frequency phase shifter assembly. This allows the flexible provision of high-frequency phase shifter assemblies having different numbers of high-frequency phase shifters since a corresponding number of high-frequency phase shifters which each have their own housings are stacked on one another in dependence on the requirement. The housings of the individual high-frequency phase shifters do not have any axial passage at least on one side in the region of the rotary axle of the pick-up element and thus likewise allows a good electrical decoupling of the individual high-frequency phase shifters in the stack.

The individual high-frequency phase shifters can be arranged at a smaller spacing from one another in the stack due to the improved decoupling achieved by the lacking continuous rotary axle, the spacing between the housings of high-frequency phase shifters following one another in the stack can be less than 11 mm, optionally less than 8 mm, further optionally less than 5 mm, and further optionally less than 2 mm. Provision can furthermore be made that the housings of the high-frequency phase shifters in the stack lie on one another, optionally with the interposition of an insulating layer. The construction height is hereby reduced.

Independently of a common housing for the high-frequency phase shifter assembly or of respective separate housings for the high-frequency phase shifters, the housing or housings may be configured as closed housings. Such a closed housing may have a base plate and a top plate which may extend perpendicular to the rotary axle of the pick-up element and has side walls which extend between the base plate and the top plate and close the housing. However, certain openings can naturally be provided in the individual plates or walls. The openings, however, may have less than 20% of the surface of the housing, further optionally less than 10%. In a possible embodiment, the side walls can be formed as angled sections of a metal sheet forming the top plate and can be connected via fastening lugs, for example, to a metal sheet forming the base plate. The housing may be formed from metal or have a metallic coating. For example, instead of a metal housing, a plastic housing having a metallic surface can be used, in particular a housing of electroplated plastic.

The specific design of the coupling arrangement via which the mechanical coupling of the pick-up elements of the individual high-frequency phase shifters takes place in the stack can initially be in accordance with the present disclosure. What is solely decisive here is that the mechanical coupling does not take place by a common rotary axle of the pick-up elements, but rather by a coupling arrangement spaced apart from the rotary axles to allow the separation of the rotary axles by the housing plate.

The coupling arrangement can be arranged wholly or partly outside the housing or housings in a possible embodiment. In this case, the rotary axle of the pick-up elements may be led out of the housing at one side and is connected to the coupling arrangement there. The rotary axle is in contrast not led out of the housing at the other side, but is rather at least partly separated from the next rotary axle by a housing plate.

The coupling arrangement can in an alternative embodiment be arranged wholly or partly inside the housing or housings. In this case, the rotary axle of the pick-up elements is not led out of the housing at all, but is rather connected to the coupling arrangement inside the housing. The rotary axle of one or more pick-up elements can, however, optionally also be led out of the housing at one side with a coupling arrangement arranged inside the housing and can serve as a drive axle for the high-frequency phase shifter assembly.

Possible embodiments for mechanical coupling arrangements in accordance with the present disclosure will be shown in more detail in the following:

In a first possible embodiment, the mechanical coupling of the pick-up elements of the high-frequency phase shifters takes place by a gearing. The gearing may have at least one connection shaft extending offset from the rotary axles of the pick-up elements. The connection shaft may extend in parallel with the rotary axles, but at a certain spacing from them.

In this respect, respective first gearing elements may be rotationally fixedly connected to the pick-up elements and cooperate with second gearing elements which are arranged at the connection shaft to transmit a rotational movement between the connection shaft and the pick-up elements. The gearing elements can in particular be gear wheels or geared segments. The first and second gearing elements can be arranged such that they directly mesh with one another. Optionally, however, further gearing elements can also be interposed between the first and second gearing elements.

The second gearing elements are coupled with one another by the connection shaft in accordance with the present disclosure and thus allow a mechanical coupling of the pick-up elements without the rotary axles of the pick-up elements being directly coupled to one another. For unlike in the prior art, the pick-up elements thus do not have a common rotary axle, but rather the second gearing elements spaced apart from the rotary axle.

The gearing which is used for the mechanical coupling of the individual pick-up elements of the high-frequency phase shifters can be arranged in a possible embodiment completely outside the housing of the high-frequency phase shifter assembly or outside the housings of the individual high-frequency phase shifters. For this purpose, the rotary axle of the pick-up elements can respectively be led out of the housing at one side and can be rotationally fixedly connected to the first gearing element there. The first gearing elements, the second gearing elements and the connection shaft can thus be arranged outside the respective housings. The gearing, however, may be at least partly arranged within the housing of the high-frequency phase shifter assembly or of the respective housings of the high-frequency phase shifters, at least the first and second gearing elements can in particular be arranged within the housing or housings.

The connection shaft is optionally led via an axial passage through the at least one housing plate arranged between the high-frequency phase shifters. An aperture admittedly has to be provided for the connection shaft of the second gearing elements in the housing plate which separates the high-frequency phase shifters in the stack. This is, however, no longer arranged in the region of the rotary axle of the pick-up element and of the coupling point for the electrical coupling of the pick-up element in accordance with the present disclosure, but rather remote herefrom so that the axial aperture has no negative influence on the decoupling of the high-frequency phase shifters. The connection shaft may be arranged on a side disposed opposite the stripline sections with respect to the rotary axle of the pick-up element.

In a possible embodiment, the high-frequency phase shifter assembly has a common housing, with the connection shaft also extending within the housing. The coupling arrangement may thus be located completely within the housing.

To be able to actuate the high-frequency phase shifter assembly or to be able to adjust the pick-up elements synchronously, the connection shaft or at least one of the rotary axles of the pick-up elements or a further drive shaft can be led out of the housing.

In accordance with a further, preferred embodiment of the present disclosure, the high-frequency phase shifters each have their own housings, with the housings being stacked on one another and connected to one another to form the high-frequency phase shifter assembly, a respective gearing element is arranged within the housing of a high-frequency phase shifter; it is rotationally fixedly connected to the pick-up and cooperates with a second gearing element likewise arranged in the housing of the high-frequency phase shifter. The first and second gearing elements may be rotatably supported in or at the housing. The first gearing element can in particular be rotatably supported together with the pick-up element. The second gearing elements can in particular be arranged offset next to the first gearing element and optionally mesh with them. The rotary axles of the first and second gearing elements optionally extend in parallel with this respect.

The second gearing elements arranged in the respective housings can be coupled to one another in accordance with the present disclosure. The second gearing elements of the high-frequency phase shifters stacked above one another may be connected to one another via a connection shaft led in the respective housings through axial passages.

In a first possible embodiment, the second gearing elements can be connected to one another by a continuous connection shaft passing through shaft openings in the second gearing elements. The desired number of high-frequency phase shifters can hereby be stacked on one another and the second gearing elements can then be connected in a mechanically coupled manner by pushing the connection shaft through the shaft openings of the second gearing elements.

In an alternative embodiment, the second gearing elements can each have connection shaft sections which are connected to a connection shaft section of a second gearing element of a high-frequency phase shifter arranged below or above it. This also allows a simple stacking of any desired number of high-frequency phase shifters. The connection shaft sections can optionally be connectable to one another via a plug-in connection and/or releasably.

The housing of the high-frequency phase shifters may have apertures for the connection shaft at both sides of the rotary axle of the second gearing elements.

In accordance with the present disclosure, a plurality of high-frequency phase shifters of identical design at least with respect to the housing and to the connection of the second gearing elements can be put together to form a high-frequency phase shifter assembly in accordance with the present disclosure. The housings of the individual high-frequency phase shifters can have connection points, for example in their base plate, via which the individual high-frequency phase shifters arranged in the stack can be connected to one another, for example, by the passing through of connection elements.

In a possible embodiment of the present disclosure, the gear ratio of the gearing can the same for each high-frequency phase shifter of the high-frequency phase shifter assembly so that an identical adjustment of the high-frequency phase shifters results on a movement of the gearing.

In an alternative embodiment, the gearing for the respective high-frequency phase shifter can, however, also have different gear ratios so that a respective different adjustment of the individual high-frequency phase shifters results on a movement of the gearing. The high-frequency phase shifters in the stack are admittedly still moved synchronously, but with different adjustment angles so that different phase shifts accordingly result.

As just described, a gearing can thus be used as a mechanical coupling arrangement for coupling the pick-up elements of the high-frequency phase shifters in the stack. The present disclosure is, however, not limited to this embodiment.

In an alternative embodiment, the mechanical coupling of the pick-up elements of the high-frequency phase shifters can in contrast take place via a lever arrangement. The levers may be respectively rotationally fixedly connected to the pick-up elements and extend away from the rotary axle of the pick-up elements so that they can be coupled to one another in a region which is spaced apart from the rotary axle. An arrangement of rods can be provided for moving the levers. The coupling of the levers of the individual high-frequency phase shifters can either take place indirectly via the arrangement of rods or directly, for example, via a connection rod.

The coupling between the linkage and the levers may take place via one or more slotted guides in which one or more entrainer pins are guided. A displacement of the arrangement of rods in a direction tangential to the rotary axle of the pick-up element hereby results in a rotational movement of the lever and of the pick-up element, with the guide pin moving along in the slotted guide. The slotted guide may be formed as an elongate hole. In a possible embodiment, the guide pin is arranged at the lever and is guided in a slotted guide arranged at the arrangement of levers.

In a first possible embodiment, the levers of the individual high-frequency phase shifters can have the same length or be connected to the arrangement of rods in the same manner so that an identical adjustment of the high-frequency phase shifters results on a movement of the arrangement of rods. If the coupling of the levers to the arrangement of rods takes place respectively separately via a separate slotted guide, the guide pins associated with the individual levers may have the same spacing from the rotary axle of the lever and thus from the pick-up element so that the same lever arm respectively results. It is alternatively conceivable to connect the individual levers directly and rigidly to one another so that only one guide pin and one slotted guide can be used to adjust a plurality of levers and thus a plurality of high-frequency phase shifters.

In an alternative embodiment, the levers of the individual high-frequency phase shifters can have different lengths and/or can be connected separately to the arrangement of rods so that different adjustments of the individual high-frequency phase shifters result on a movement of the arrangement of rods. The entrainer pins associated with the individual levers may have different spacings from the rotary axle of the levers or of the pick-up elements so that different lever arms result. On a linear adjustment of the arrangement of rods, a respective different rotational movement of the levers and thus of the pick-up elements hereby results. The pick-up elements admittedly hereby continue to be adjusted, but generate different phase shifts.

The levers associated with the respective pick-up elements may extend in a plane which is perpendicular to the rotary axle of the pick-up element. The levers may extend radially to the rotary axle of the pick-up element.

In a first possible embodiment, the levers can each be led out the housing through a slit therein on the side of the rotary axle disposed opposite the pick-up element. A small construction height hereby results.

Such an arrangement is conceivable, on the one hand, when all high-frequency phase shifters in the stack have a common housing. In this case, the common housing has a corresponding number of slits in a corresponding side wall through which slits the levers are led to the outside.

Such an embodiment is, however, also conceivable when the individual high-frequency phase shifters each have their own housings. In this case, the housing of each high-frequency phase shifter has a corresponding slit through which the lever is led to the outside.

In an alternative embodiment, the rotary axles of the pick-up elements can, however, each be led out of the housing on one side and the levers can be connected to the rotary axle outside the housing. In contrast, a housing plate which separates the individual rotary axles from one another is provided at the oppositely disposed side of the rotary axles.

In an arrangement with only two phase shifters stacked above one another, the rotary axle of the pick-up element in the upper high-frequency phase shifter can be led out of the housing to the top and can be led out of the housing to the bottom in the lower one.

An arrangement is alternatively conceivable in which every high-frequency phase shifter has its own housing, with the rotary axles in each case being led out of the housing at the same side. In this case, the lever extends at least in the interior of the stack between the top plate of the housing of a phase shifter and a base plate of another phase shifter.

In addition to the above-described high-frequency phase shifter assemblies having a plurality of high-frequency phase shifters stacked on one another, the present disclosure furthermore comprises stackable high-frequency phase shifters for providing such high-frequency phase shifter assemblies.

Such a stackable high-frequency phase shifter has its own housing in which a rotatably supported pick-up element is arranged which is electrically coupled to a feed line via a coupling point arranged in the region of its rotary axle. The high-frequency phase shifter has a coupling element which allows a coupling, remote from the rotary axle of the pick-up element, of the movement of the pick-up element of the high-frequency phase shifter with the movement of a pick-up element of another high-frequency phase shifter. A high-frequency phase shifter assembly in accordance with the present disclosure can be provided by stacking one or more such high-frequency phase shifters on one another, such as was described above.

The stackable high-frequency phase shifter can be configured such as has already been described in more detail above with respect to the high-frequency phase shifter assembly.

The coupling point can in particular be electrically shielded to the outside by the housing at least toward one side of the rotary axle. Two high-frequency phase shifters stacked above one another can furthermore have an electrical decoupling of at least 25 dB, further optionally of at least 29 dB, further optionally of at least 35 dB, and further optionally of at least 40 dB.

Provision can furthermore be made that the housing in the region of the rotary axle of the pick-up element at least has no apertures toward one side of the rotary axle whose outer circumference is greater than ⅛ of the minimal wavelength of the signals at which the high-frequency phase shifter is operated. The housing may have at least has no apertures in the region of the rotary axle of the pick-up element toward one side of the rotary axle whose outer circumference is larger than 1/10 and is further optionally larger than 1/15 of the minimal wavelength of the signals.

The housing in a possible embodiment can have a thickness in the stack direction of less than 17 mm, optionally less than 15 mm, further optionally of less than 12 mm.

A first gearing element can furthermore be arranged within the housing and is rotatably fixedly connected to the pick-up element and cooperates with a second gearing element likewise arranged in the housing. The second gearing element may allow a mechanical coupling with other high-frequency phase shifters in the stack.

The housing in particular has an axial passage for a connection shaft at both sides in the region of the second gearing element. The second gearing elements of the individual high-frequency phase shifters and thus their pick-up elements can be mechanically coupled to one another for this connection shaft without the rotary axles of the pick-up elements having to be directly connected to one another.

In a possible embodiment, the second gearing element has a shaft opening through which the connection shaft can be pushed. Alternatively, the second gearing element can have a connection shaft section which is connectable to a connection shaft section of a high-frequency phase shifter arranged thereabove or thereunder. The connection shaft sections may be connectable to one another via a plug-in connection and/or releasably.

Alternatively to the gearing, the high-frequency phase shifter can also have a lever via which the pick-up element is movable. The lever is rotationally fixedly connected to the rotary axle of the pick-up element for this purpose.

In a first possible embodiment, the lever can be connected to the pick-up element in the housing and can be led out of the housing through a slit on the side of the rotary axle disposed opposite the pick-up element.

Alternatively, the rotary axle of the pick-up element can be led out of the housing on one side and the lever can be connected to the rotary axle outside the housing.

The housing of a stackable high-frequency phase shifter in accordance with the present disclosure can, for example, comprise a base plate, a top plate and side walls. The top plate and the side walls can be shaped by a contiguous, correspondingly bent metal plate. The base plate can have connection points which allow a connection of the individual high-frequency phase shifters in the stack, connection openings can in particular be provided through which connection elements pass which connect the individual high-frequency phase shifters to one another.

The high-frequency phase shifter in accordance with the present disclosure may be configured such that it is stackable with further high-frequency phase shifters which are at least of identical design with respect to the housing, in particular such that the rotary axles of the pick-up elements are arranged in parallel with one another and may be aligned with one another. If the mechanical coupling takes place via second gearing elements such as have already been described above, their rotary axles are optionally also aligned.

The present disclosure furthermore comprises a high-frequency antenna having a high-frequency phase shifter assembly such as has been described above and having a plurality of radiators which are controllable via the high-frequency phase shifter assembly. The radiators may be connected to the high-frequency phase shifters of the high-frequency phase shifter assembly in accordance with the present disclosure such that the radiation pattern of the antenna can be electrically oriented and in particular reduced by an adjustment of the high-frequency phase shifter assembly. It can in particular be a cellular radio antenna.

The high-frequency phase shifter assembly in accordance with the present disclosure can be able to be manually actuated in a first embodiment. For example, an adjustment element, e.g. a rotary knob, can be provided via which the high-frequency phase shifters can be adjusted. Alternatively or additionally, the high-frequency phase shifter assembly can also be adjustable by a motor. A corresponding drive motor may be provided for this purpose.

In the first embodiment, in which a gearing is used as a mechanical coupling element, the adjustment element or the drive motor can be connected to the connection shaft, to a rotary axle of a pick-up element or to an additional drive axis. In the second embodiment, in which a lever arrangement is used as the coupling arrangement, the adjustment element or the drive motor may move an arrangement of rods coupled to the levers.

The present disclosure will now be represented in more detail with reference to embodiments and to drawings.

DETAILED DESCRIPTION

Figure 1:
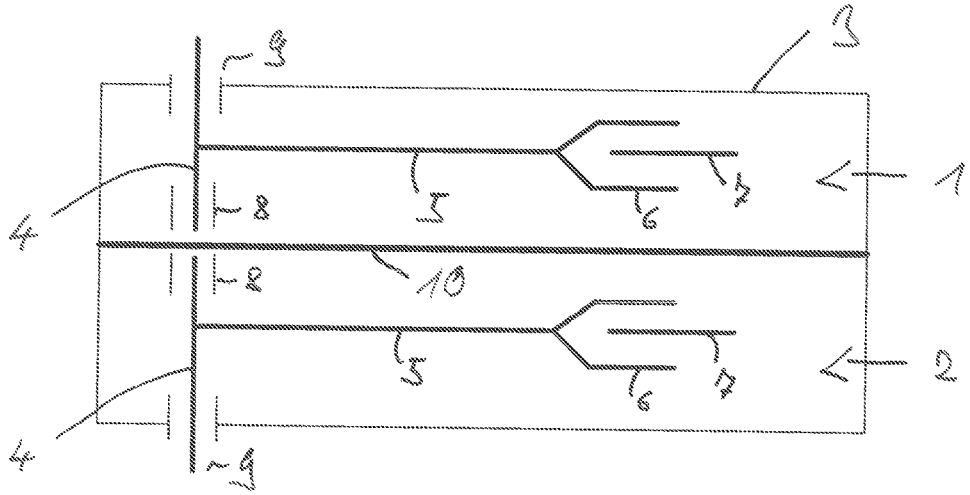
FIG. 1 shows a schematic diagram of the decoupling in accordance with the present disclosure of the high-frequency phase shifters in accordance with the present disclosure in the region of the drive axles of the pick-up elements.

In FIG. 1, the basic structure of a high-frequency phase shifter assembly in accordance with the present disclosure and of the high-frequency phase shifters is shown in more detail as well as the basic principle of the electrical decoupling in accordance with the present disclosure of the high-frequency phase shifters in the stack, The high-frequency phase shifter assembly shown in FIG. 1 has a first high-frequency phase shifter 1 and a second high-frequency phase shifter 2 which are arranged stacked above one another. Each of the high-frequency phase shifters 1, 2 has a rotatably supported pick-up element 5 having a corresponding rotary axle 4. The pick-up element 5 is electrically coupled in the region of the rotary axle 4 to a feed line via a coupling point not shown in more detail in FIG. 1. The coupling may take place capacitively.

The pick-up element 5 is configured in pointer shape and has a coupling point 6 with which it is electrically coupled to a stripline section 7. The coupling here also may take place capacitively. One or both ends of the stripline section 7 form connector points for radiators which are supplied with a signal from the high-frequency phase shifter. The stripline section 7 may be arranged in arcuate form about the rotary axle 4 of the high-frequency phase shifter. A rotation of the pick-up element 5 thus varies the position of the coupling point 6 with respect to the ends of the stripline section 7. Thereby, the path length for a signal travelling via the pick-up element 5 and the stripline section 7 to one of the connectors of the radiators is varied. The phase position is varied by the varied path length.

In the embodiment shown in FIG. 1, the pick-up element 5 only has one coupling point 6 and one stripline section 7. A plurality of coupling points 6 for a plurality of stripline section 7 can, however, also be provided. In this case, the stripline sections may be arranged at different spacings from the rotary axle of the high-frequency phase shifter and the coupling points provided for the stripline sections are arranged behind one another in the direction of extension of the pick-up element. A plurality of radiators can hereby be controlled synchronously, but with different phase shifts.

The high-frequency phase shifters 1 and 2 in the stack are arranged above one another such that the rotary axles 4 of the high-frequency phase shifters 1 and 2 are aligned with one another. This allows a particularly compact arrangement of the high-frequency phase shifters. Unlike in the prior art, the pick-up elements 5, however, do not have a common mechanical rotary axle. The high-frequency phase shifters 1 and 2 can hereby be electrically decoupled from one another by a housing plate 10 in the region of the rotary axles 4 of their pick-up elements 5 so that the coupling points of the respective feed lines into the respective pick-up elements 5 are also electrically decoupled in the region of the rotary axles.

The housing plate 10 may have no apertures or only apertures which are so small in the region of the rotary axle 4 that they also do not relevantly impair the electrical shielding in the maximum frequency range of the high-frequency phase shifter assembly and with minimally permitted wavelengths. The openings—where present—can, for example, be selected as so small that the high-frequency phase shifters have a decoupling of at least 25 dB, and optionally of at least 35 dB. The ends of the rotary axles 4 are respectively supported via a bearing 8 toward the housing plate 10.

The high-frequency phase shifter assembly has a closed housing 3 to electrically shield the high-frequency phase shifter assembly and the individual high-frequency phase shifters 1 and 2 in the stack.

In the embodiment shown in FIG. 1, the high-frequency phase shifters 1 and 2 have a common housing 3 and are electrically decoupled from one another by the housing plate 10 designed as an intermediate plate. Alternatively, however, each high-frequency phase shifter can also have its own housing, with the housings of the individual high-frequency phase shifters then being stacked above one another with their housings being connected to one another.

In order to synchronously adjust the rotary axles despite the separation by the housing plate 10, a mechanical coupling arrangement is required which is not shown in more detail in FIG. 1 and which is spatially separate from the rotary axles 4.

In this respect, the high-frequency phase shifter assembly can also comprise more than two high-frequency phase shifters stacked above one another which are then each separated from one another in the region of the rotary axles by housing plates and whose pick-up elements are mechanically coupled by a coupling arrangement spaced apart from the rotary axles.

The mechanical coupling can take place outside the housing 3 in the embodiment shown in FIG. 1, the rotary axle 4 of the upper phase shifter 1 is guided out of the housing 3 to the top via a passage 9 and the rotary axle 4 of the lower phase shifter 2 is guided out through a lower passage 9. The mechanical coupling arrangement can therefore engage at the rotary axles 9 outside the housing 3 and can couple them outside the housing.

Figure 7:
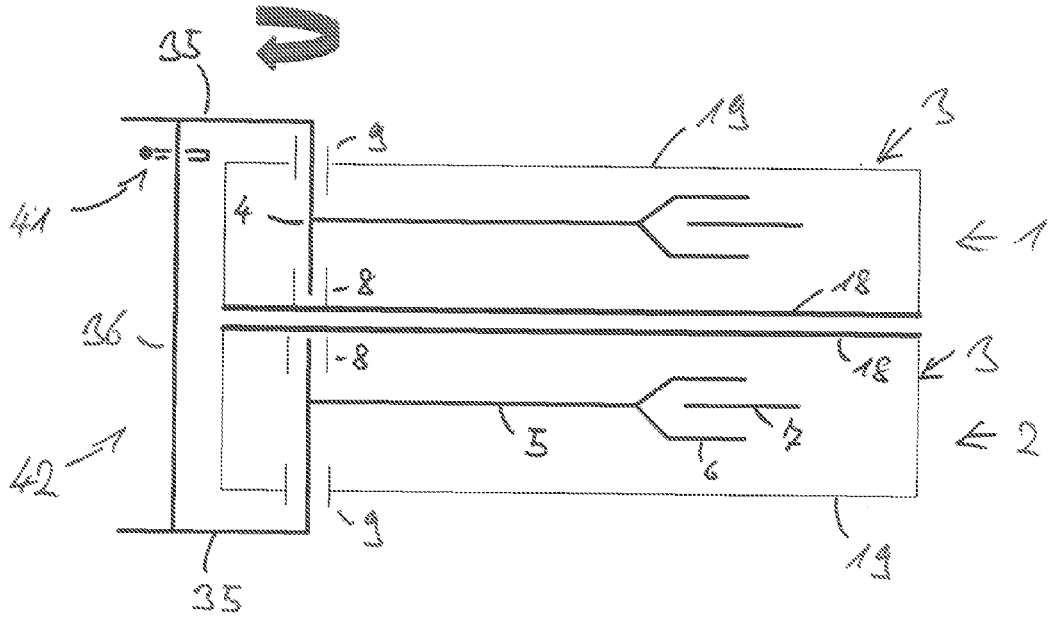
FIG. 7 shows in a schematic diagram, a fifth embodiment of a high-frequency phase shifter assembly in accordance with the present disclosure, wherein the coupling of the pick-up elements takes place via a lever arrangement.
Figure 8:
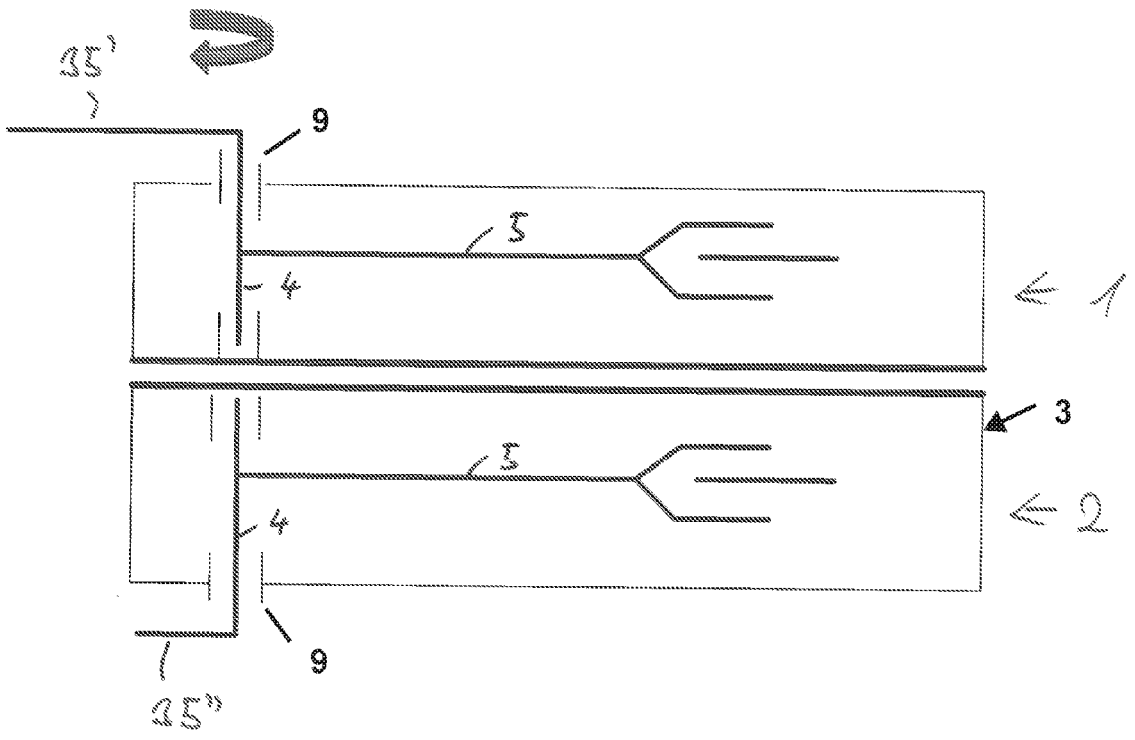
FIG. 8 shows in a schematic diagram, a sixth embodiment of a high-frequency phase shifter assembly in accordance with the present disclosure, wherein the coupling takes place via a lever arrangement, with differently long levers being used for the individual high-frequency phase shifters.

The coupling can, for example, take place via a gearing arranged outside the housing or, as explained in even more detail with reference to FIGS. 7 and 8, via a lever arrangement arranged outside the housing.

The coupling arrangement can, however, also be arranged wholly or partly in the interior of the housing, as will be explained in more detail in the following.

In this respect, embodiments of high-frequency phase shifter assemblies and of coupling arrangements used will be described in more detail in the following with respect to FIGS. 2 to 8. The basic structure of these high-frequency phase shifter assemblies and/or of the high-frequency phase shifters used corresponds to the structure already described with reference to FIG. 1.

Figure 2:
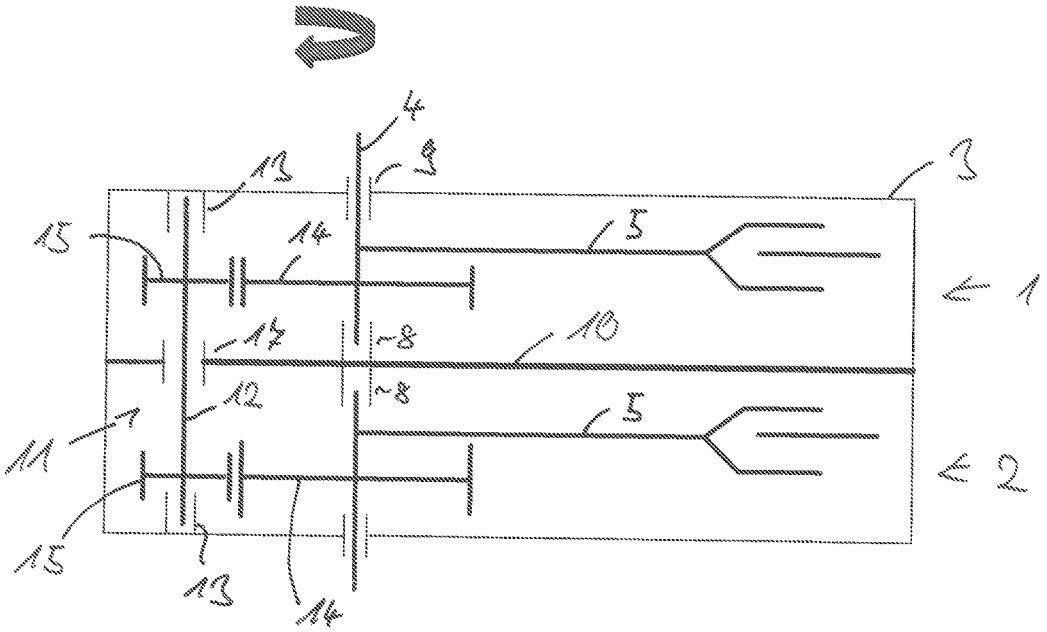
FIG. 2 shows in a schematic diagram, a first embodiment of a high-frequency phase shifter assembly in accordance with the present disclosure in which a gearing is used for the mechanical coupling of the pick-up elements and the drive takes place via an end of a rotary axle of one of the pick-up elements led out of the housing.

A first embodiment of a high-frequency phase shifter assembly having a gearing 11 as the coupling arrangement for the rotary axles of the pick-up elements 5 is shown in FIG. 2. The gearing 11 has a connection shaft 12 which is arranged spaced apart from the rotary axles 4 of the pick-up elements 5 and which provides an indirect mechanical coupling of the rotary axles. The gearing further comprises first gearing elements 14 which are connected rotationally fixedly to the pick-up elements 5 and which each cooperate with second gearing elements 15 rotationally fixedly arranged at the connection shaft 12. In the embodiment, the first gearing elements 14 and the pick-up element 5 are arranged together on the respective rotary axle 4. The gearing elements 14 and 15 can in particular be cogs or cog segments. In the embodiment, the first gearing elements 14 associated with the pick-up elements 5 mesh directly with the second gearing elements 15 associated with the connection shaft 12.

In the embodiment shown in FIG. 2, the gearing 11 and thus the coupling arrangement are arranged completely within the housing 3. The connection shaft 12 is supported at bearing points 13 in the housing 3 for this purpose, the housing plate 10 arranged between the phase shifters 1 and 2 has an axial passage 17 for the connection shaft 12. The connection shaft 12 and thus the axial passage 17 are arranged in the embodiment with respect to the rotary axle 4 on the side disposed opposite the pick-up element 5 or the stripline sections 7 and thus in a region in which no significant signal-conducting sections of the phase shifters extend. The shaft passage 17 therefore has no negative effect on the decoupling.

The adjustment of the phase shifters takes place in the embodiment shown in FIG. 2 via one of the rotary axles 4 of the pick-up elements which are each led out of the housing 3 via a passage 9 on one side. It would, however, be sufficient if only one rotary axle of a high-frequency phase shifter were led out of the housing since the other high-frequency phase shifter is anyway co-adjusted via the gearing 11.

Figure 3:
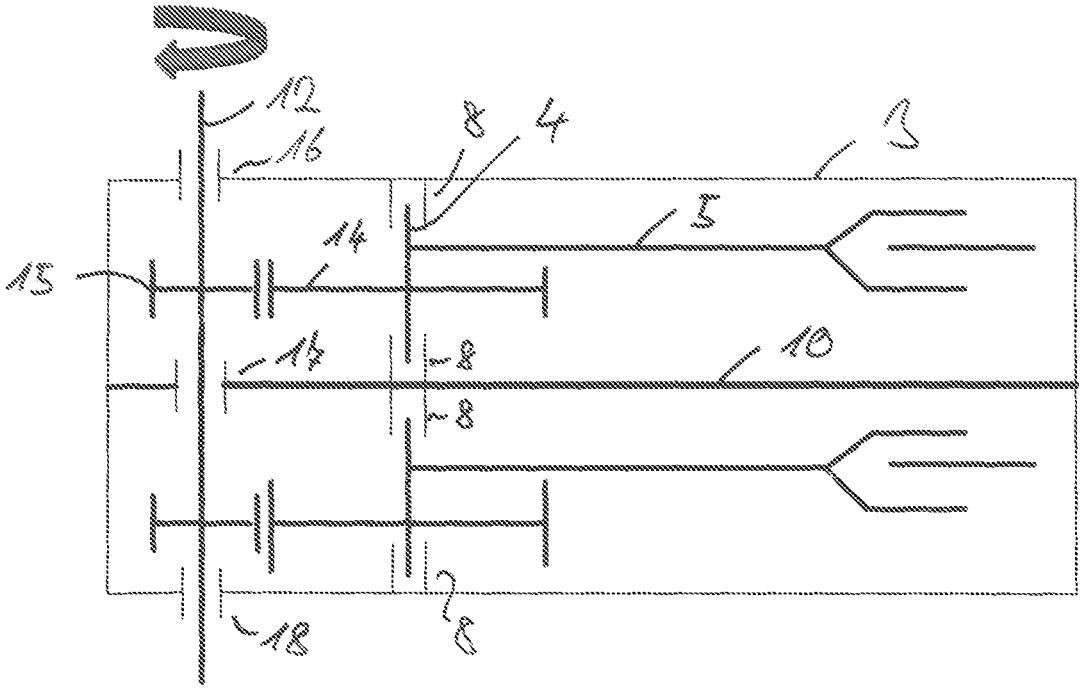
FIG. 3 shows in a schematic diagram, a second embodiment of a high-frequency phase shifter assembly in accordance with the present disclosure in which the mechanical coupling of the pick-up elements takes place by a gearing, with the drive taking place via the connection shaft of the gearing led out of the housing.

FIG. 3 shows a further embodiment of a high-frequency phase shifter assembly in accordance with the present disclosure which is substantially the same in its basic structure as the embodiment shown in FIG. 2. Unlike there, however, the adjustment does not take place via one of the rotary axles 4 of the phase shifters, but rather via the connection shaft 12 of the gearing. For this purpose, the connection shaft 12 is led out of the housing 3 via a passage 16. The rotary axles 4 of the phase shifters 5 are, in contrast, each supported on both sides via bearings 8 at or in the housing 3 and are not led out thereof.

In the embodiment shown in FIG. 3, the connection shaft 12 is also led out of the housing 3 via a passage 18 on the lower side. This allows further high-frequency phase shifters to be optionally arranged in the stack and likewise to be driven via the connection shaft. The second passage 18 could, however, optionally also be dispensed with.

Figure 4:
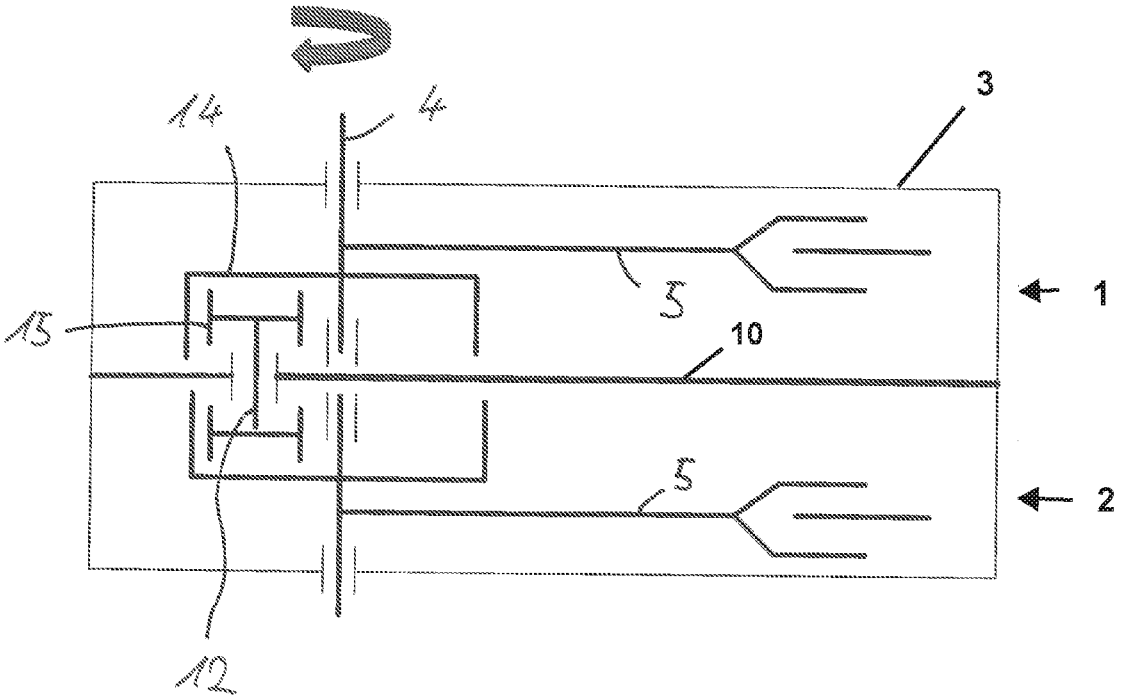
FIG. 4 shows in a schematic diagram, a third embodiment of a high-frequency phase shifter assembly in accordance with the present disclosure in which the coupling of the pick-up elements takes place via a gearing and the drive takes place via a rotary axle of a pick-up element led out of the housing.

A further variant of the basic structure shown in FIG. 2 is shown in FIG. 4. The mechanical coupling also takes place here via a gearing having a connection shaft 12 which extends in parallel with the rotary axles 4 of the pick-up elements 5. The adjustment furthermore also takes place here via the outwardly led rotary axles 4 of the pick-up elements. Unlike the embodiments shown in FIGS. 2 and 3, in which the first and second gearing elements 14 and 15 each have an external toothed arrangement, in the embodiment shown in FIG. 4, however, first gearing elements 14 having an internal toothed arrangement are used which cooperated with second gearing element 15 having an external toothed arrangement.

In the embodiments shown in FIGS. 2 to 4, the high-frequency phase shifter assembly has a common housing 3 for all high-frequency phase shifters, with the individual high-frequency phase shifters 1 and 2 being separated from one another by a housing plate configured as an intermediate plate of the housing.

The gearing arrangements shown in this embodiment can, however, also be used when each high-frequency phase shifter has its own housing. In this case, only the intermediate plate 10 of the housing used in the embodiments in FIGS. 2 to 4 has to be divided into a top plate for the lower phase shifter and a base plate for the upper phase shifter.

Figure 5:
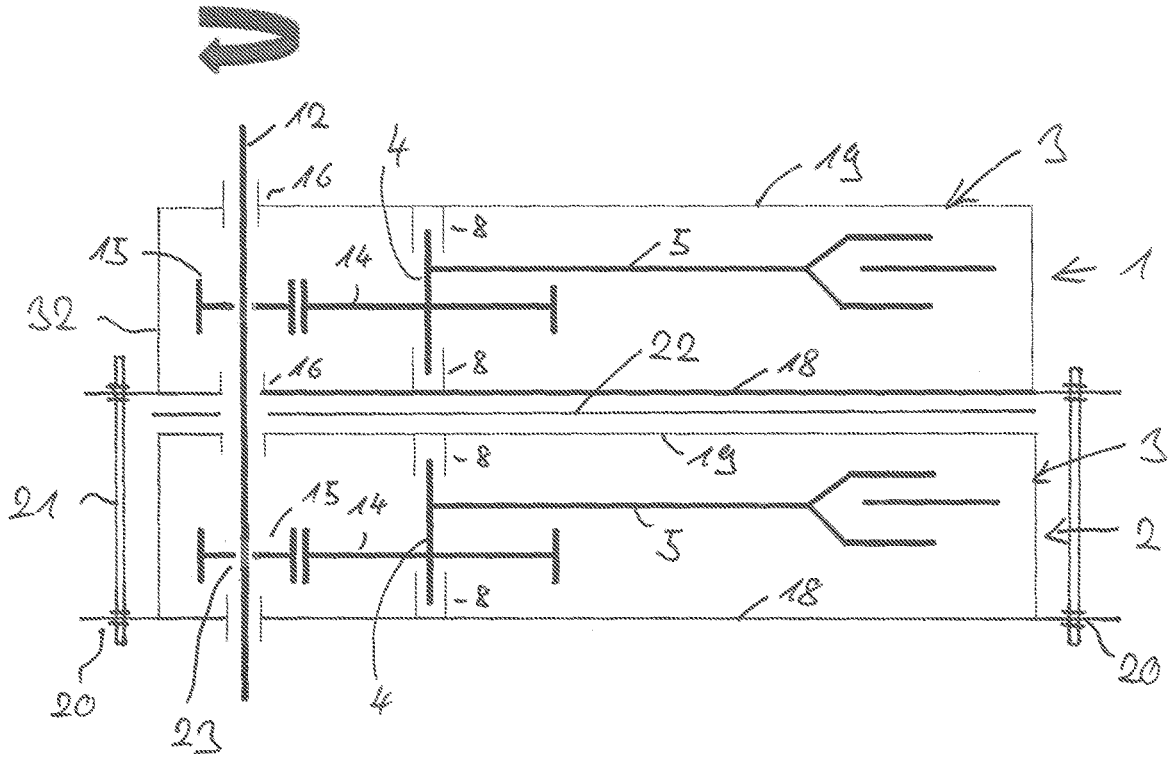
FIG. 5 shows in a schematic diagram, a fourth embodiment of a high-frequency phase shifter assembly in which the coupling of the pick-up elements takes place via a gearing, with the high-frequency phase shifters each having a separate housing and the drive taking place via a connection shaft led out of the housing.

An embodiment of a high-frequency phase shifter assembly is now shown in FIG. 5 in which the high-frequency phase shifters 1 and 2 each have their own housing 3. The housings 3 of the high-frequency phase shifters each comprise a base plate 18 and a top plate 19 as well as side walls 32 and thus each form a closed housing for the phase shifters 1 and 2. The phase shifters 1 and 2 are arranged above one another in the stack, with the housings 3 of the high-frequency phase shifters being connected to one another. In the embodiment, the base plates 18 of the housings have connection points 20 for this purpose which are connected to one another via connection elements 21 extending in the direction of the stack. The individual high-frequency phase shifters 1 and 2 are therefore arranged on one another such that the rotary axles 4 of the pick-up elements 5 are aligned with one another. The rotary axles 4 are, however, not led out of the housing 3, but are rather supported at bearing points 8 at the top and at the bottom in or at the housing. The individual high-frequency phase shifters in the stack are thus decoupled from one another by the base plate 18 and/or the top plate 19 in the region of the rotary axle 4 and of the coupling points arranged there for the electrical coupling of the signals into the pick-up elements 5 since no axial passage is provided for the rotary axles 4, the base plate 18 of the upper phase shifter 1 comes to lie on the top plate 19 of the lower phase shifter 2 in the stack. An insulating layer 22 is interposed, however, to separate the housings electrically from one another.

The mechanical coupling of the pick-up elements 5 of the individual phase shifters in the stack takes place in the embodiment shown in FIG. 5 via a gearing which works in exactly the same manner as the gearing shown in FIG. 3, first gearing elements 14 are in particular provided which are rotationally fixedly connected to the pick-up elements 5 and which cooperate with second gearing elements 15 arranged in an offset manner, cogs or cog segments, in particular with an external toothed arrangement, can be used as gearing elements. The first and second gearing elements 14 and 15 associated with a high-frequency phase shifter are arranged and supported in the respective housing 3. A connection shaft 12 is furthermore provided on which the second gearing elements 15 are rotationally fixedly arranged. The connection shaft 12 which connects the second gearing elements 15 to one another passes through the housings 3. For this purpose, respective passages 16 for the connection shaft 12 are provided in the base plate 18 and in the top plate 19.

In the embodiment, the connection shaft 12 is configured as a continuous shaft which can be pushed through shaft receivers 23 of the second gearing elements 15. It would alternatively be conceivable to arrange respective connection shaft sections which can be plugged into one another at the second gearing elements 15. Different connection kinds are also conceivable instead of the plug-in connection.

The structure of the high-frequency phase shifter assembly shown in FIG. 5 of a plurality of stackable high-frequency phase shifters having their own housings allows the setup of high-frequency phase shifter assemblies with any desired number of high-frequency phase shifters stacked above one another, high-frequency phase shifter assemblies can in particular be set up having three or more high-frequency phase shifters stacked above one another.

Figure 6:
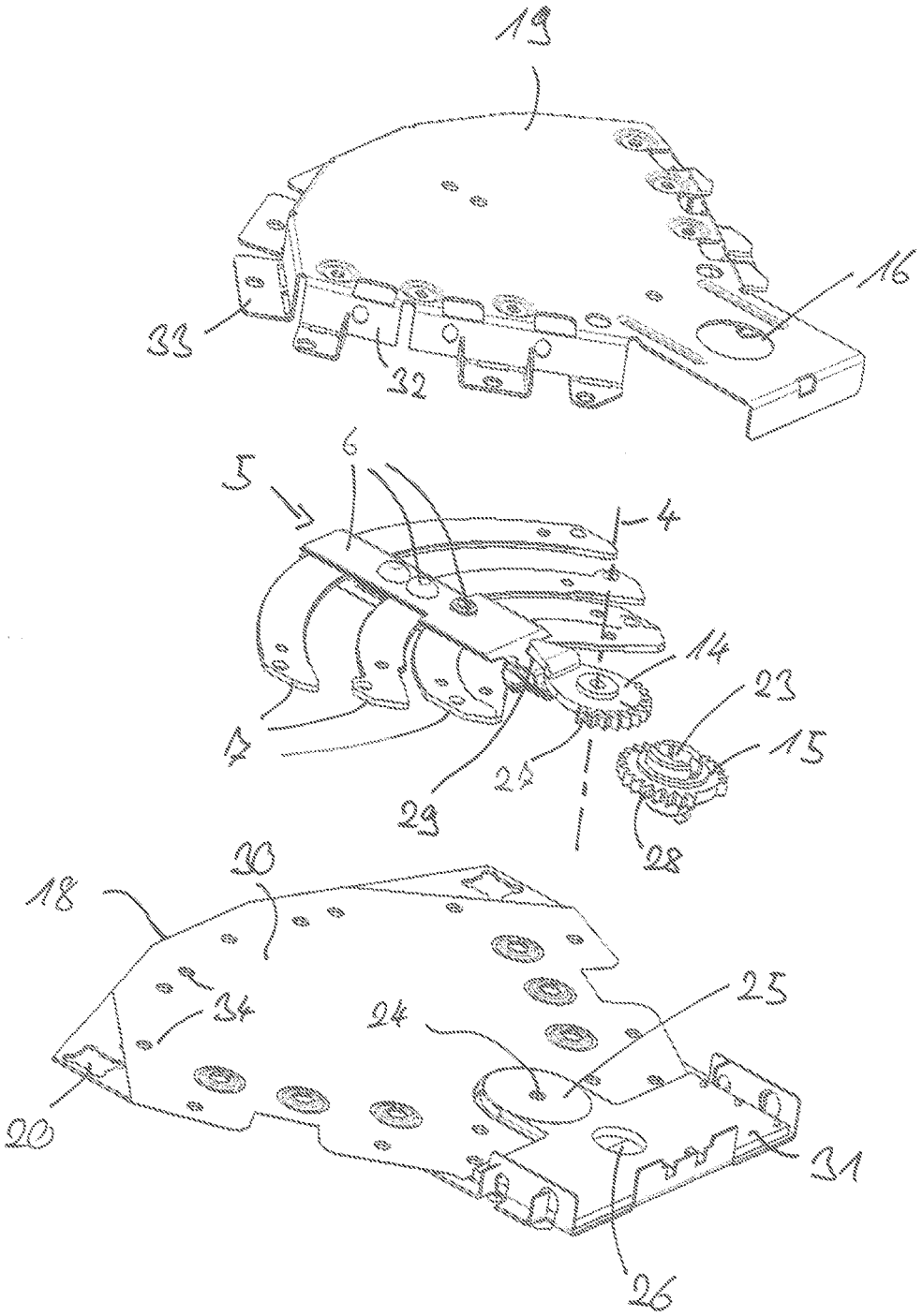
FIG. 6 shows in an exploded representation, an embodiment of a stackable high-frequency phase shifter in accordance with the present disclosure which is suitable for providing a high-frequency phase shifter assembly in accordance with the embodiment shown in FIG. 5.

In FIG. 6, a more detailed embodiment of a stackable high-frequency phase shifter having a separate housing is show such as can be used in the embodiment of a high-frequency phase shifter assembly shown in FIG. 5.

FIG. 6 shows the stackable high-frequency phase shifter in an exploded representation, with the base plate 18 of the housing being able to be seen in the lower region, while the top plate 19 of the housing is shown in the upper region with the side wall regions 32 angled away therefrom as well as fastening lugs 33 for fastening to the fastening points 34 of the base plate 18.

A bearing arrangement 24 on which the pick-up element 5 is supported rotatable about a rotary axle 4 is shown on the base plate 18. A plurality of stripline sections 7 are furthermore arranged on the base plate 18 and are capacitively coupled to the pick-up element 5 at coupling points 6, an insulating layer 30 is provided between the base plate 18 and the stripline sections 7. As shown in FIG. 6, the pick-up element 5 extends in pointer shape in the radial direction, while the stripline sections 7 are arranged in arcuate form about the rotary axle 4, connectors are provided for connecting radiators to the ends of the stripline sections.

The coupling of the signal into the pick-up element 5 takes place via an annular coupling point 25 which is arranged in the region of the axial support 24 of the pick-up element 5 and is capacitively coupled to an annular coupling disk of the pick-up element 5 which cannot be recognized in FIG. 6. The coupling in the region of the rotary axle is independent of the angle of rotation of the pick-up element 5 due to the respective annular coupling elements. A connector for the galvanic connection of the coupling point 25 can be provided in the region 31.

A first gearing element 14 is rotationally fixedly connected to the pick-up element 5. The gearing element 14 comprises a cog segment having a partial external toothed arrangement 27 and is rotationally fixedly connected to the pick-up element 5 via an entrainer pin 29. The first gearing element 14 is rotatably supported about the rotary axle 4 via a bearing arrangement not shown in detail in the same way as the pick-up element.

A second gearing element 15, which is likewise configured as a cog segment having a partial external toothed arrangement 28, is provided for the mechanical connection to further high-frequency phase shifters in the stack. The external toothed arrangements 27 and 28 of the first and second gearing elements 14 and 15 mesh directly with one another. The second gearing element is likewise rotatably connected in or at the housing, and indeed about a rotary axle extending in parallel with the rotary axle 4 of the pick-up element or of the first gearing element 14, a lower bearing point 26 can be seen in FIG. 6.

The base late and the top plate of the housing have apertures 16 in the region of the rotary axle of the second gearing element 15 through which a connection shaft can pass. The second gearing element 15 has a coded shaft passage 23 so that the second gearing elements of the high-frequency phase shifters can be connected to one another rotationally fixedly via a continuous connection shaft in the stack and can be driven together via the connection shaft.

In this respect, a plurality of identical high-frequency phase shifters can be used in the stack. It is, however, also conceivable to equip the phase shifters, for example, with a different number of or with differently arranged stripline sections 7. It is equally conceivable to generate different gear ratios for the individual high-frequency phase shifters by different pairings of the first and second gearing elements 14 and 15. The mechanical coupling can nevertheless take place in an identical manner. All the high-frequency phase shifters in particular have identical housings and identical connection regions for the second gearing elements 15.

A further embodiment variant of a high-frequency phase shifter assembly in accordance with the present disclosure is shown in FIGS. 7 and 8 in which the mechanical coupling of the high-frequency phase shifters 1 and 2 in the stack does not take place via a gearing, but rather via a lever arrangement 42 of levers 35 coupled to one another. In the embodiments show in FIGS. 7 and 8, the two high-frequency phase shifters 1 and 2 each have separate housing with base plates 18 facing one another and outwardly disposed top plates 19. The high-frequency phase shifters could, however, also have a common housing, as shown in FIG. 1, for example, or can be stacked on one another with an identical orientation.

The levers 35 are each rotationally fixedly connected to the pick-up elements 5 of the high-frequency phase shifters 1 and 2 and extend in a plane perpendicular to the rotary axles 4, the levers 35 extend on the side disposed opposite the pick-up element 5 with respect to the rotary axle 4.

The levers 35 may be moved via an arrangement of rods 41 which is moved perpendicular to the plane of the drawing. A slotted guide can be arranged at the arrangement of rods and a guide pin arranged at the lever is guided in said slot so that a linear movement of the arrangement of rods 41 is converted into a rotational movement of the levers. Alternatively, the slotted guide can also be arranged at the levers.

In the embodiment shown in FIG. 7, the two levers 35 are directly connected to one another via a coupling rod 36 which also serves as a common guide pin for the two levers 35 in the embodiment. In this embodiment, the movement of the arrangement of rods generates an identical adjustment movement of the two phase shifters 1 and 2.

In the embodiment shown in FIG. 8, the lever 35' of the first phase shift 1 and the lever 35" of the second phase shift 2 in contrast have different lever lengths. The levers 35' and 35" are separately connected to one or more slotted guides of an arrangement of rods, not shown, wherein the guide pins each have a different radial spacing from the rotary axle 4 and hereby generate the different lever lengths. The coupling of the levers 35' and 35" in this case takes place via the arrangement of rods. A movement of the arrangement of rods generates rotary movements of the pick-up elements 5 of different amounts due to the different lever lengths.

In the embodiments shown in FIGS. 7 and 8, the rotary axles 4 of the pick-up elements are each led out of the respective housing on one side via a passage 9 and are connected to the levers 35 outside the housing, in the embodiment, the rotary axle of the upper high-frequency phase shifter 1 is at the top, the rotary axle of the lower high-frequency phase shifter is led out of the respective housing 3 at the bottom. Alternatively, however, the arrangement of one of the two phase shifters 1, 2 could also be rotated about 180° so that the rotary axles of both high-frequency phase shifters in the stack are each led out at the same side. For this purpose, only a corresponding intermediate space for the lever would have to be provided between the top plate of a lower high-frequency phase shifter and the base plate of the upper high-frequency phase shifter.

In an alternative embodiment, not shown, the lever can be rotationally fixedly connected to the pick-up element 5 in the housing and can be led out of the housing via a slit. The rotary axle of the pick-up element 5 does not have to be led out of the housing at all in said slit, but its two ends can rather be supported within the housing or at the housing, the lever in such an embodiment can be arranged on the side disposed opposite the pick-up element 5 with respect to the rotary axle 4 and can in particular prolong the pick-up element 5 in the oppositely disposed direction. Such a configuration allows the stack height of the high-frequency phase shifters to be reduced again.

Alternatively to the embodiments shown in FIGS. 7 and 8 with separate housings for the high-frequency phase shifters, the high-frequency phase shifter assembly can also have a common housing for the high-frequency phase shifters having a corresponding intermediate plate.

Figure 9A:
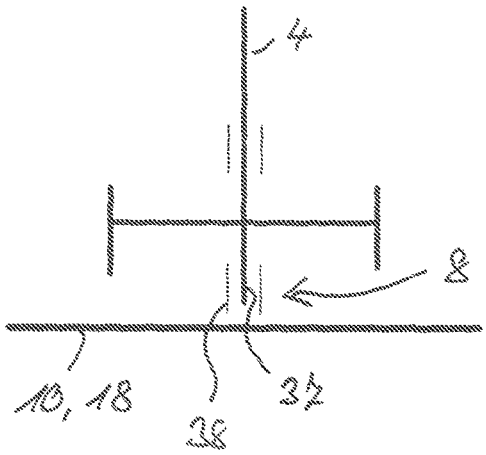
FIG. 9A shows a first support variant for the rotary axle of a pick-up element at a housing plate.
Figure 9B:
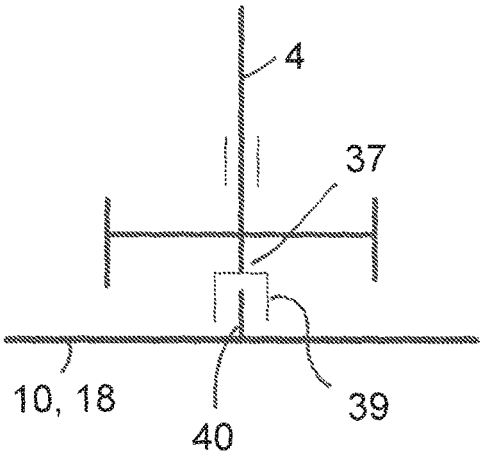
FIG. 9B shows a second embodiment of the support of a rotary axle of a pick-up element at a housing plate.

Two variants are now shown in FIGS. 9A and 9B as to how a rotary axle 4 of a pick-up element 5 can be supported in or at the housing, what is shown is the support of the at least one end 37 of the rotary axle 4 not led out of the housing, with the support in particular taking place in the region of the housing plate 10 or 18 respectively. In the variant shown in FIG. 9A, the end 37 of the rotary axle 4 is supported in a bearing sleeve 38 which is arranged at the housing plate 10. In the variant shown in FIG. 9B, the end 37 of the rotary axle 4 in contrast has a bearing cup 39 into which a bearing pin 40 connected to the housing plate 10, 18 engages. The support naturally does not have to take place directly at the housing plate 10, 18, but can rather also take place via a separate bearing arrangement arranged in the housing.

The separation in accordance with the present disclosure of the rotary axles of the pick-up elements of the individual high-frequency phase shifters in the stack and the interposition of a housing plate shielding the coupling points for the signals into the pick-up elements from one another allows an improved electrical decoupling of the individual high-frequency phase shifters independently of the specific support. In accordance with the present disclosure, the electrical coupling of the signals in the region of the rotary axle and the mechanical coupling of the pick-up elements is spatially separate and thus makes possible an improved electrical decoupling in the individual pick-up elements in the stack.

The high-frequency phase shifter assembly is in particular used for controlling antenna arrays, in particular to be able to reduce the radiation pattern. Alternatively or additionally, an azimuth adjustment of the radiation pattern is thus also possible. The adjustment can take place manually and/or via a drive motor.

The invention claimed is:

1. A high-frequency phase shifter assembly having at least two high-frequency phase shifters arranged in a stack, the stack comprising one high-frequency phase shifter located above another high-frequency phase shifter, and which are arranged in at least one housing, wherein at least one housing plate is provided between the high-frequency phase shifters in the stack;

wherein the high-frequency phase shifters each have a rotatably supported pick-up element which is electrically coupled to a feed line via a coupling point arranged in a region of a rotary axle of the pick-up element;

wherein the pick-up elements of the high-frequency phase shifters are mechanically coupled for a synchronous adjustment of the high-frequency phase shifters;

wherein the mechanical coupling of the pick-up elements of the high-frequency phase shifters takes place via a coupling arrangement spaced apart from the rotary axles of the pick-up elements; and wherein the high-frequency phase shifters have an electrical decoupling of at least 25 dB; and/or wherein spacing of the high-frequency phase shifters in the stack is less than 17 mm; and/or wherein the at least one housing plate arranged in the stack between the high-frequency phase shifters has no apertures in the region of the rotary axles of the pick-up elements whose outer circumference is greater than ⅛ of a minimal wavelength of signals with which the high-frequency phase shifter assembly is operated.

2. The high-frequency phase shifter assembly in accordance with claim 1, wherein the at least one housing comprises a housing for each of the high-frequency phase shifters, with the housings of the high-frequency phase shifters being stacked on one another and connected to one another to form the high-frequency phase shifter assembly; and wherein the housings of the high-frequency phase shifters are disposed on one another in the stack, while interposing an insulating layer.

3. A high-frequency antenna having the high-frequency phase shifter assembly according to claim 1, the high-frequency antenna having a plurality of radiators which are controllable via the high-frequency phase shifter assembly.

4. The high-frequency antenna in accordance with claim 3, wherein the plurality of radiators is connected to the high-frequency phase shifters of the high-frequency phase shifter assembly such that a radiation pattern of the antenna is adjusted by an adjustment of the high-frequency phase shifter assembly.

5. The high-frequency antenna in accordance with claim 4, wherein the antenna is a cellular radio antenna.

6. The high-frequency antenna in accordance with claim 4, wherein the adjustment is an azimuth adjustment; and wherein the adjustment is done manually or via a drive motor.

7. A high-frequency phase shifter assembly having at least two high-frequency phase shifters arranged in a stack, the stack comprising one high-frequency phase shifter located above another high-frequency phase shifter, and which are arranged in at least one housing, wherein at least one housing plate is provided between the high-frequency phase shifters in the stack;

wherein the high-frequency phase shifters each have a rotatably supported pick-up element which is electrically coupled to a feed line via a coupling point arranged in a region of a rotary axle of the pick-up element;

wherein the pick-up elements of the high-frequency phase shifters are mechanically coupled for a synchronous adjustment of the high-frequency phase shifters;

wherein the mechanical coupling of the pick-up elements of the high-frequency phase shifters takes place via a coupling arrangement spaced apart from the rotary axles of the pick-up elements; and wherein the mechanical coupling of the pick-up elements of the high-frequency phase shifters takes place via a gearing; wherein the gearing has at least one connection shaft extending spaced apart from the rotary axles of the pick-up elements; and wherein first gearing elements rotationally fixedly connected to the pick-up elements cooperate with second gearing elements which are arranged at the connection shaft to transmit a rotational movement between the connection shaft and the pick-up elements.

8. The high-frequency phase shifter assembly in accordance with claim 7, wherein a gear ratio of the gearing is the same for each high-frequency phase shifter so that an identical adjustment of the high-frequency phase shifters results in a movement of the gearing; or wherein the gearing has different gear ratios for the respective high-frequency phase shifters so that a different adjustment of the high-frequency phase shifters results in the movement of the gearing.

9. The high-frequency phase shifter assembly in accordance with claim 7, wherein the first gearing elements and the second gearing elements are arranged in the at least one housing, with the connection shaft or at least one of the rotary axles of the pick-up elements or a further drive shaft being guided out of the at least one housing for actuation of the high-frequency phase shifter assembly.

10. The high-frequency phase shifter assembly in accordance with claim 7, wherein the at least one housing comprises a housing for each of the high-frequency phase shifters which are stacked on one another and are connected to one another for forming the high-frequency phase shifter assembly; and wherein the first gearing elements and the second gearing elements are arranged in respective housings.

11. The high-frequency phase shifter assembly in accordance with claim 10, wherein the second gearing elements of the high-frequency phase shifters stacked above one another are connected to one another via the connection shaft led through the high-frequency phase shifter housings; and wherein the second gearing elements are connectable via a continuous connection shaft passing through shaft openings in the second gearing elements or the second gearing elements each have connection shaft sections which are connectable to one another in a pluggable manner.

12. A high-frequency antenna having the high-frequency phase shifter assembly according to claim 7, the high-frequency antenna having a plurality of radiators which are controllable via the high-frequency phase shifter assembly.

13. The high-frequency antenna in accordance with claim 12, wherein the plurality of radiators is connected to the high-frequency phase shifters of the high-frequency phase shifter assembly such that a radiation pattern of the antenna is adjusted by an adjustment of the high-frequency phase shifter assembly.

14. The high-frequency antenna in accordance with claim 13, wherein the adjustment is an azimuth adjustment; and wherein the adjustment is done manually or via a drive motor.

15. The high-frequency antenna in accordance with claim 12, wherein the antenna is a cellular radio antenna.

16. A high-frequency phase shifter assembly having at least two high-frequency phase shifters arranged in a stack, the stack comprising one high-frequency phase shifter located above another high-frequency phase shifter, and which are arranged in at least one housing, wherein at least one housing plate is provided between the high-frequency phase shifters in the stack;

wherein the high-frequency phase shifters each have a rotatably supported pick-up element which is electrically coupled to a feed line via a coupling point arranged in a region of a rotary axle of the pick-up element;

wherein the pick-up elements of the high-frequency phase shifters are mechanically coupled for a synchronous adjustment of the high-frequency phase shifters;

wherein the mechanical coupling of the pick-up elements of the high-frequency phase shifters takes place via a coupling arrangement spaced apart from the rotary axles of the pick-up elements; and wherein the mechanical coupling of the pick-up elements of the high-frequency phase shifters takes place via a lever arrangement; wherein levers are each led out of the at least one housing through a slit on a side of the rotary axle disposed opposite the pick-up element; or wherein the rotary axles of the pick-up elements are each led out of the housing on one side and the levers are each connected to the rotary axle outside the housing.

17. The high-frequency phase shifter assembly in accordance with claim 16, wherein the levers are movable by an arrangement of rods, with the coupling between the arrangement of rods and the levers taking place via one or more slotted guides in which one or more entrainer pins are guided, with the slotted guide being configured as an elongate hole; and/or wherein the levers of the individual high-frequency phase shifters have a same length and/or are connected to the arrangement of rods in the same manner so that an identical adjustment of the high-frequency phase shifters results in a movement of the arrangement of rods; or wherein the levers of the individual high-frequency phase shifters have different lengths and/or are separately connected to the arrangement of rods so that different adjustments of the high-frequency phase shifters result in the movement of the arrangement of rods.

18. A high-frequency antenna having the high-frequency phase shifter assembly according to claim 16, the high-frequency antenna having a plurality of radiators which are controllable via the high-frequency phase shifter assembly.

19. The high-frequency antenna in accordance with claim 18, wherein the plurality of radiators is connected to the high-frequency phase shifters of the high-frequency phase shifter assembly such that a radiation pattern of the antenna is adjusted by an adjustment of the high-frequency phase shifter assembly.

20. The high-frequency antenna in accordance with claim 19, wherein the adjustment is an azimuth adjustment; and wherein the adjustment is done manually or via a drive motor.

21. The high-frequency antenna in accordance with claim 18, wherein the antenna is a cellular radio antenna.

22. A stackable high-frequency phase shifter for a high-frequency phase shifter assembly, the high-frequency phase shifter having its own housing in which a rotatably supported pick-up element is arranged, the pick-up element electrically coupled to a feed line via a coupling point arranged in a region of a rotary axle of the pick-up element; wherein the high-frequency phase shifter has a coupling element which allows a coupling, the coupling spaced apart from the rotary axle of the pick-up element, of a movement of the pick-up element of the high-frequency phase shifter with a movement of a pick-up element of another high-frequency phase shifter; and wherein the coupling point is electrically shielded toward an outside by the housing toward at least one side of the rotary axle; wherein two high-frequency phase shifters stacked above one another have an electrical decoupling of at least 25 dB; and/or wherein the housing has no apertures in the region of the rotary axle of the pick-up element at least toward one side of the rotary axle whose outer circumference is greater than ⅛ of a minimal wavelength of signals with which the high-frequency phase shifter is operated.

23. A stackable high-frequency phase shifter for a high-frequency phase shifter assembly, the high-frequency phase shifter having its own housing in which a rotatably supported pick-up element is arranged, the pick-up element electrically coupled to a feed line via a coupling point arranged in a region of a rotary axle of the pick-up element; wherein the high-frequency phase shifter has a coupling element which allows a coupling, the coupling spaced apart from the rotary axle of the pick-up element, of a movement of the pick-up element of the high-frequency phase shifter with a movement of a pick-up element of another high-frequency phase shifter; wherein a first gearing element is arranged within the housing, said first gearing element being rotationally fixedly connected to the pick-up element and cooperating with a second gearing element arranged in the housing; and wherein the housing has a passage for a connection shaft at both sides in a region of the second gearing element.

24. A stackable high-frequency phase shifter for a high-frequency phase shifter assembly, the high-frequency phase shifter having its own housing in which a rotatably supported pick-up element is arranged, the pick-up element electrically coupled to a feed line via a coupling point arranged in a region of a rotary axle of the pick-up element; wherein the high-frequency phase shifter has a coupling element which allows a coupling, the coupling spaced apart from the rotary axle of the pick-up element, of a movement of the pick-up element of the high-frequency phase shifter with a movement of a pick-up element of another high-frequency phase shifter; wherein the pick-up element is movable by a lever; wherein the lever is led out of the housing through a slit on a side of the rotary axle disposed opposite the pick-up element; or wherein the rotary axle of the pick-up element is led out of the housing on one side and the lever is connected to the rotary axle outside the housing.

* * * * *